United States Patent [19]

Llewellyn et al.

[11] 4,362,615

[45] Dec. 7, 1982

[54] FROTH FLOTATION OF RUTILE

[75] Inventors: Thomas O. Llewellyn, Tuscaloosa; Gerald V. Sullivan, Northport, both of Ala.

[73] Assignee: The United States of America as represented by the Secretary of the Interior, Washington, D.C.

[21] Appl. No.: 311,487

[22] Filed: Oct. 15, 1981

[51] Int. Cl.[3] ..... B03D 1/14

[52] U.S. Cl. ..... 209/167; 209/166; 75/1 T

[58] Field of Search ..... 209/166, 167; 75/1 T

[56] References Cited

U.S. PATENT DOCUMENTS 2,145,206 1/1939 Booth ..... 209/166
2,412,500 12/1946 Fischer ..... 209/166
3,669,266 6/1972 Sanders et al. ..... 209/166

FOREIGN PATENT DOCUMENTS 692316 8/1964 Canada ..... 209/166

*Primary Examiner*—Bernard Nozick
*Attorney, Agent, or Firm*—William S. Brown; Donald A. Gardiner

[57] ABSTRACT

Rutile is recovered from copper ore tailings by means of a froth flotation process comprising: (a) flotation of sulfides and carbonates at a pH of about 9 to 10, using sodium isopropyl xanthate and sodium oleate as collectors, and detrine as rutile depressant, and (b) flotation of rutile from the resulting tailings at a pH of about 2 to 3, using hydrofluoric acid as a rutile selectivity-assisting agent and water-soluble petroleum sulfonate as rutile collector.

7 Claims, No Drawings

FROTH FLOTATION OF RUTILE

This invention relates to recovery of rutile, $TiO_2$, the chief source of titanium and titanium compounds, from copper ores or tailings by means of a froth flotation process. Rutile is used to manufacture titanium pigment, an ingredient used in surface coatings. Because of its high refractive index, rutile imparts whiteness, opacity and brightness to paints. These same qualities also make it useful for paper coatings or as paper filler. Another major use of rutile is in the manufacture of titanium sponge. In aerospace applications, titanium metal is useful because of its high strength-to-weight ratio. Other uses for rutile include welding-rod coatings, ceramic and glass formulations, carbides, and special alloys. The United States is presently largely dependent on foreign sources for rutile. However, efficient recovery of rutile from domestic porphyry copper ores or tailings could substantially reduce dependence on foreign sources for the critical mineral.

It has now been found that rutile may be effectively recovered from copper ores or tailings by means of a process comprising initial flotation of sulfides and carbonates, followed by flotation of rutile. The preferred feed materials in the process of the invention are tailings from the removal of the major proportion of the copper from porphyry copper ores by conventional means such as flotation. Exemplary of such tailings is that employed in the example below, which contained about 0.76 percent $TiO_2$, 0.1 percent of residual copper, 2.0 percent of iron and 1.2 percent sulfur, with the balance comprising a mixture of mineral constituents such as feldspar, quartz, pyrite, calcite and biotite, with lesser amounts of muscovite, chlorite, zircon and molybdenite.

The feed is preferably initially ground to a particle size sufficient to liberate rutile from other minerals, e.g., about minus 200-mesh. However, it may also be used at a particle size of about minus 35-mesh, which is readily prepared by screening. In either case, the material is preferably deslimed, as by decantation at about 10 micrometers (equivalent quartz diameter). The minus 200-mesh plus 10 micrometers, or minus 35-mesh plus 10 micrometers, fraction is then conditioned and a sulfide-carbonate concentrate is floated at a pH of about 9 to 10.

Conditioning, as well as subsequent flotation, may be carried out in any conventional cell suitable for froth flotation, and at ambient temperature and pressure. Water is added to provide a pulp density of about 20 percent solids and the pH is adjusted to approximately 9 to 10, preferably by addition of sodium carbonate as required. Conditioning agents consist of collectors for sulfides and carbonates, as well as a rutile depressant. Sodium isopropyl xanthate is the preferred sulfide collector, and is employed in an amount of about 0.05 to 0.5 pound, preferably about 0.1 pound, per ton of tailings. Sodium oleate, in amounts of about 0.1 to 1.0 pound, preferably about 0.2 pound, per ton of tailings, is the preferred carbonate collector. The rutile depressant preferably consists of dextrin, in amounts of about 0.05 to 0.5 pound, preferably about 0.3 pound, per ton of tailings. Suitable conditioning periods will generally range from about 2 to 8 minutes.

Preferably, a water-soluble alcohol is added as a frother, in an amount of 0.05 to 0.2 pound, preferably about 0.12 pound, per ton of tailings. Air is then introduced in conventional manner for a period of about 4 to 6 minutes to float a rougher sulfide-carbonate concentrate. Preferably, this concentrate is cleaned by refloating to remove any titanium particles entrapped therein.

The floated sulfide-carbonate bearing froth is removed and the remaining slurry is thickened to approximately 40 percent solids, and the pH is adjusted to about 2.0 to 3.0 with sulfuric acid. The pulp is then conditioned for a similar period with a rutile selectivity-assisting agent, preferably hydrofluoric acid, in an amount of about 0.1 to 1.0 pound, preferably about 0.5 pound, per ton of tailings, and with a rutile collector, preferably consisting of petroleum sulfonate, in an amount of about 0.5 to 2.0 pounds, preferably about 1.0 pound, per ton of tailings. A rutile rougher concentrate is then floated over a period of about 3 to 6 minutes. The rougher rutile concentrate is preferably cleaned at least twice by means of the same flotation procedure. Each cleaning stage will, however, usually require addition of further sulfuric acid to maintain the pH in the required range.

The invention will be more specifically illustrated by the following example.

EXAMPLE

A series of tests were conducted using a 2,000-gram flotation cell for all rougher flotation operations, and a 250-gram cell for the cleaning operations. The two flotation cells were used in this way so that a higher pulp density could be obtained during the cleaning flotation stages. To prepare a sample for flotation, the above-described tailings material was screened on a 200-mesh sieve. The oversize, which amounted to 47.4 weight-percent of the sample, was stage ground in tap water to minus 200-mesh. The ground material was then added to the material that was previously sieved to minus 200-mesh, and the pulp was deslimed by decantation at 10 micrometers (equivalent quartz diameter).

The minus 200-mesh plus 10 micrometers fraction was conditioned with sodium isopropyl xanthate and sodium oleate as collectors, and with dextrin added to the pulp for depression of rutile. A water soluble alcohol was added as frother, and a rough sulfide-carbonate concentrate consisting mainly of pyrite and calcite was floated at a pH of 9.8.

Next, the sulfide-carbonate tailings (nonfloat) was filtered, repulped and conditioned with Promoter 825, a water-soluble petroleum sulfonate available from American Cyanamid Co. as a collector and hydrofluoric acid as a rutile selectivity-assisting agent, and a rougher rutile concentrate was floated at a pH of 2.4 (pH adjustment by addition of $H_2SO_4$). The rougher rutile concentrate was cleaned two times, each cleaning stage requiring adjustment of pulp pH with $H_2SO_4$.

A summary of the test conditions and the reagents schedule for these tests are shown in Table 1, while results of the tests are shown in Table 2.

TABLE 1

Reagents schedule for sulfide-carbonate and rutile flotation

| Operating conditions | Sulfide-carbonate | | | Rutile | | | |
|---|---|---|---|---|---|---|---|
| | Conditioner | Rougher | Cleaner | Conditioner | Rougher | Cleaner First | Cleaner Second |
| Reagent, pounds per ton of flotation feed: | | | | | | | |
| Xanthate | 0.10 | 0 | 0 | 0 | 0 | 0 | 0 |
| Dowfroth | .12 | 0 | 0 | 0 | 0 | 0 | 0 |
| Dextrin | .30 | 0 | 0 | 0 | 0 | 0 | 0 |
| Sodium carbonate | .50 | 0 | 0 | 0 | 0 | 0 | 0 |
| Sodium oleate | .20 | 0 | 0 | 0 | 0 | 0 | 0 |
| Hydrofluoric acid | 0 | 0 | 0 | 0.5 | 0 | 0.03 | 0.03 |
| Sulfuric acid | 0 | 0 | 0 | 4.0 | 0 | 0 | 0 |
| Petroleum sulfonate | 0 | 0 | 0 | 1.0 | 0 | 0 | 0 |
| Conditioning time minutes | 6 | NAp[1] | NAp | 5 | NAp | NAp | NAp |
| Flotation time minutes | NAp | 5 | 5 | NAp | 5 | 3 | 3 |
| Pulp pH | 9.9 | 9.9 | 9.9 | 2.4 | 2.4 | 2.5 | 2.4 |
| Pulp temperature °C. | 22 | 22 | 22 | 23 | 23 | 22 | 22 |

[1]NAp—Not applicable.

TABLE 2

Results of sulfides, carbonates, and rutile flotation

| Product | Weight-percent | Analysis, percent $TiO_2$ |
|---|---|---|
| Rutile cleaner concentrate | 1.2 | 34.8 |
| Sulfide-carbonate cleaner concentrate | 6.8 | .4 |
| Rutile cleaner tailings No. 1 | 2.1 | .6 |
| Rutile cleaner tailings No. 2 | .7 | 1.8 |
| Rutile rougher tailings | 64.3 | .3 |
| Minus 10-micrometer slimes | 24.9 | .5 |
| Composite | 100.0 | — |

We claim:

1. A froth flotation process for recovery of rutile from copper ore tailings comprising:

(a) flotation of sulfides and carbonates at a pH of about 9 to 10, using sodium isopropyl xanthate and sodium oleate as collectors, and dextrin as rutile depressant, and (b) flotation of rutile from the tailings of step (a) at a pH of about 2 to 3, using hydrofluoric acid as a rutile selectivity-assisting agent and water-soluble petroleum sulfonate as rutile collector.

2. The process of claim 1 in which the copper ore tailings are tailings from removal of copper from porphyry copper ores by flotation.

3. The process of claim 1 in which the copper ore tailings are initially ground to a particle size of about minus 200-mesh.

4. The process of claim 1 in which the copper ore tailings are deslimed prior to flotation.

5. The process of claim 1 in which water is added to the copper ore tailings in an amount to provide a slurry of about 20 percent by weight of solids prior to flotation of sulfides and carbonates.

6. The process of claim 1 in which the tailings from step (a) are adjusted to about 40 percent by weight of solids prior to flotation of rutile.

7. The process of claim 1 in which sulfuric acid is used to adjust the pH to about 2 to 3 in step (b).

* * * * *